US008646198B2

(12) United States Patent
Atherton et al.

(10) Patent No.: US 8,646,198 B2
(45) Date of Patent: Feb. 11, 2014

(54) SECURITY DEVICE

(75) Inventors: Peter Samuel Atherton, Leesburg, VA (US); David G. Rodriguez, Bronx, NY (US); Bruce John Semmler, Spencerport, NY (US); Jeffrey Charles Robertson, Rochester, NY (US)

(73) Assignee: Mikoh Corporation, McLean, CA (US)

( * ) Notice: Subject to any disclaimer, the term of this patent is extended or adjusted under 35 U.S.C. 154(b) by 175 days.

(21) Appl. No.: 12/988,130

(22) PCT Filed: Apr. 14, 2009

(86) PCT No.: PCT/AU2009/000461

§ 371 (c)(1),
(2), (4) Date: Mar. 7, 2011

(87) PCT Pub. No.: WO2009/126998

PCT Pub. Date: Oct. 22, 2009

(65) Prior Publication Data

US 2011/0147256 A1 Jun. 23, 2011

(30) Foreign Application Priority Data

Apr. 16, 2008 (AU) ..... 2008901885
Aug. 8, 2008 (AU) ..... 2008904070

(51) Int. Cl.
*G09F 3/18* (2006.01)

(52) U.S. Cl.
USPC ..... 40/649; 40/653; 283/98

(58) Field of Classification Search
USPC ..... 206/459.5; 283/100, 101, 80, 81, 98, 283/99; 70/439, 440; 40/649, 6; 292/307 A, 292/307 R
See application file for complete search history.

(56) References Cited

U.S. PATENT DOCUMENTS

| | | | | |
|---|---|---|---|---|
| 381,326 | A * | 4/1888 | Brooks | 220/319 |
| 3,497,041 | A | 2/1970 | Samhammer | |
| 3,971,458 | A | 7/1976 | Koenig | |
| 5,452,930 | A * | 9/1995 | Morgan | 292/307 A |
| 5,568,951 | A * | 10/1996 | Morgan | 292/307 A |
| 5,893,587 | A * | 4/1999 | Wong | 283/98 |
| 6,439,625 | B1 * | 8/2002 | Schainholz et al. | 292/307 A |
| 6,516,639 | B1 | 2/2003 | Eaton et al. | |
| 7,201,410 | B1 * | 4/2007 | Lassen | 292/307 R |
| 7,565,760 | B2 * | 7/2009 | Maier-Hunke | 40/611.08 |
| 7,578,083 | B2 * | 8/2009 | Luinstra | 40/454 |
| 8,052,180 | B1 * | 11/2011 | Lassen | 292/307 A |
| 2008/0245791 | A1 | 10/2008 | Atherton | |

FOREIGN PATENT DOCUMENTS

WO WO 2006/086848 A1 8/2006

OTHER PUBLICATIONS

International Search Report (PCT/ISA/210) issued on May 19, 2009, by Australian Patent Office as the International Searching Authority for International Application No. PCT/AU2009/000461.

* cited by examiner

*Primary Examiner* — Joanne Silbermann
*Assistant Examiner* — Christopher E Veraa
(74) *Attorney, Agent, or Firm* — Buchanan Ingersoll & Rooney PC

(57) ABSTRACT

A container to receive goods to be held securely. The container includes a hollow body with walls, and a lid with walls. A security assembly extends between one of the walls and one of the walls to provide evidence of opening and/or tamper. The security assembly includes a pair of inserts between which a tag (seal) extends that is altered if a container is opened or tampered with.

18 Claims, 15 Drawing Sheets

SECURITY DEVICE

TECHNICAL FIELD

The present invention relates to security devices and more particularly to inserts applied to containers to provide an indication when the container has been opened or tampered with.

BACKGROUND OF THE INVENTION

Described in International Patent Application PCT/AU2006/000213 (WO 2006/086848) is a reusable container that has "inserts" that enable an indication of whether the container has been opened. Extending across adjacent edges of the inserts is a tamper indicating label or tag that includes electronics enabling the label or tag to store information that can be read by a remote reading device using radio frequency (RF) communications means. A pressure sensitive adhesive is used with the label or tag to attach the label or tag to adjacent surfaces of the inserts.

A radio frequency identification (RFID) label or tag can incorporate tamper indication, such that its RFID function is modified if the RFID label or tag is applied to a surface and subsequently tampered by being partially or completely removed from the said surface. In this way the tamper status of the RFID label can be monitored remotely and automatically by using an RFID reading device.

The inserts of the above described International patent application have the disadvantage that they are easily reproduced and therefore the manufacturer lacks control over their reproduction. This detracts from the overall security of the container and its associated inserts.

OBJECT OF THE INVENTION

It is the object of the present invention to overcome or substantially ameliorate the above disadvantage.

SUMMARY OF THE INVENTION

There is disclosed herein a plurality of inserts to be located each in a respective slot so that the inserts have adjacent surfaces between which a label, seal or tag is to extend and to be fixed thereto, said inserts including:

a first insert to be inserted in one of the slots in a first insert direction, the first insert having a first major surface and at least one security feature interrupting said surface so as to extend therefrom to provide at least one security surface extending in said first insert direction; and a second insert to be inserted in another of said slots in a second insert direction, the second insert having a first major surface and at least one security feature interrupting the first major surface of said second insert so as to extend therefrom to provide at least one security surface extending in said second insert direction.

Preferably, each insert has at least two of said features.

Preferably, each security feature is a groove or ridge extending longitudinally in the direction of the respective insert.

Preferably, each insert has at least one groove and at least one recess.

Preferably, said first insert direction is generally normal to said second insert direction.

Preferably, said first insert has a leading edge, and said second insert includes a lateral edge, and wherein said edges are configured to engage to prevent separation of the inserts by movement in said first insert direction and/or said second insert direction.

Preferably, said leading edge includes a projection, and said lateral edge includes a recess to matingly engage said projection.

Preferably, said first insert direction is inclined to said second insert direction by an angle greater than 0° but equal to or less than 180°.

In an alternative preferred form, said first insert direction is opposite said second insert direction.

There is further disclosed herein the above first and second inserts with said label, seal or tag secured to said adjacent surfaces.

There is further disclosed herein a plurality of inserts to be located each in a respective slot so that the inserts have adjacent surfaces between which a label, seal or tag is to extend so as to be fixed thereto, said inserts including:

a first insert to be inserted in one of the slots in a first direction, the first insert having a major surface and a leading edge having projections and recesses; and a second insert to be inserted in another of said slots in a second direction, said second direction being opposite said first direction, the second insert having a major surface and a leading edge with a plurality of projections and recesses, with the projections and recesses of the inserts being engaged to provide for location of said adjacent surfaces so that the label, seal or tag can be applied thereto.

Preferably, at least one of said inserts has a securing portion spaced from said surface to inhibit deformation of the insert thereby inhibiting removal of the insert from its associated slots.

There is further disclosed herein in combination with said inserts a first base to receive said first insert and providing the slots within which the first insert is located, and a second base, the second base providing the slots within which said second insert is to be located, and wherein at least one of said bases has a recess to engage the security portion to prevent deformation of the insert to thereby inhibit removal of the said one insert from within the associated slots.

There is further disclosed herein a security assembly to be fixed to a container having a body and lid, said assembly including:

a first base, said first base being fixed to said body, and a second base to be fixed to said lid, and wherein said first base provides a first one of said slots, and said second base provides a second one of said slots, with each base having a security feature or features to matingly engage the security feature or features of the associated insert.

There is further disclosed herein a container having a body and lid, and the above security assembly.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
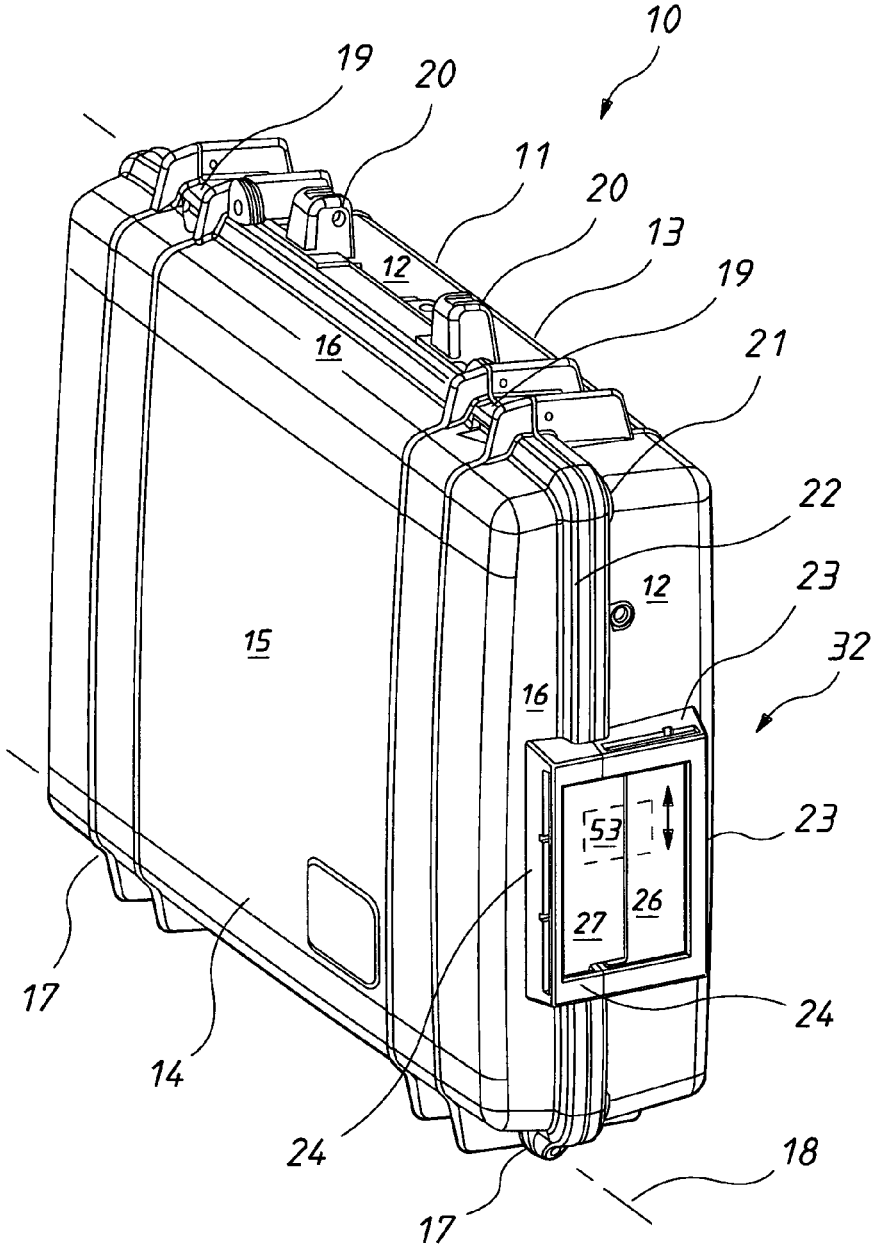
FIG. 1 is a schematic isometric view of a container such as a briefcase, including a security assembly.
Figure 2:
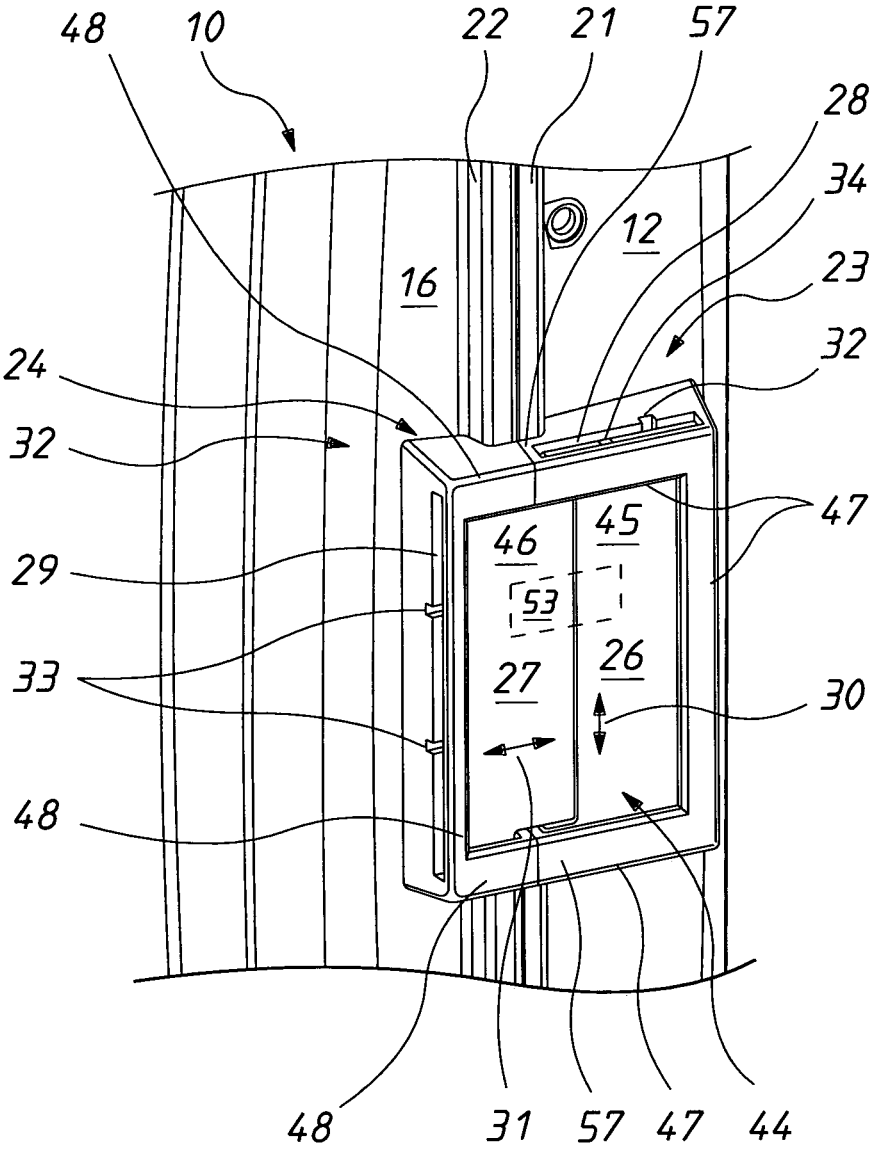
FIG. 2 is a schematic isometric view of the security assembly of FIG. 1.

In the accompanying drawings there is schematically depicted a container 10. The container 10 may be any type of hollow container that is to receive goods to be held securely. In this embodiment the container 10 is a briefcase. The container 10 includes a hollow body 11 having four side walls 12 and a bottom wall 13. Engaged with the body 11 is a lid 14 that includes a top wall 15 and four side walls 16. The lid 14 is pivotally attached to the body 11 by means of pivots 17 providing a pivot axis 18. Positioned remote from the pivots 17 are catches 19 that are operable to retain the lid 14 secured to the body 11. A handle may also be provided and attached to handle supports 20.

The body 11 has a rim 21 that engages the rim 22 of the lid 14 when the container 10 is closed.

The container 10 includes a security assembly 52 that is operable to provide information in respect of whether the container 10 has been opened or at least tampered with. The security assembly 52 includes a first base 23 fixed to the side wall 12 by being attached to the side wall 12 of the body 11 or formed integral therewith, and a second base 24 that is fixed to the side wall 16 by being attached to the side wall 16 of the lid 14 or formed integral therewith. The bases 23 and 24 are adjacent so as to be positioned immediately adjacent the rims 21 and 22.

Typically each base 23 and 24 would be moulded from plastics material, and would include collars 25 through which fasteners would pass to secure each of the bases 23 and 24 to their respective wall 12 or 16.

The assembly 52 further includes two inserts 26 and 27, each received within a respective slot 28 or 29. In particular the base 23 has the slot 28 that provides for sliding insertion of the insert 26 into the base 23 in the direction 30. The slot 29 provides for insertion of the insert 27 into the slot 29 of the base 24 in the direction 31.

In this particular embodiment, the base 23 is provided with a security feature in the form of a groove 32 extending in the direction 30 while the base 24 is provided with security features in the form of grooves 33 that extend in the direction 31. In that regard it should be appreciated the direction 30 is normal (perpendicular) to the direction 31.

The base 23 may have an additional security feature in the form of a ridge 34, the ridge 34 like the groove 32 extending longitudinally in the direction 30.

The insert 26 has security features including a ridge 35 and a groove 36 that extend longitudinally in the direction 30, and matingly engage with the ridge 34 and groove 32, that is the ridge 35 slidably engages in the groove 32 while the ridge 34 slidably engages in the groove 36. The insert 27 has ridges 37 that are matingly received within and slide along the grooves 33 in the direction 31. The base 24 may be provided with additional security features in the form of ridges 38 that extend longitudinally in the direction 31 that engage in corresponding security features in the form of grooves 51 in the insert 27.

The insert 26 has a periphery 39 that also matingly engages the periphery 40 of the insert 27. In this particular embodiment the periphery 39 includes a recess 41 that receives a projection 42 forming part of the periphery 40 of the insert 27. The projection 42 is on a leading edge while the recess 41 is on a lateral trailing edge.

Each of the ridges 35 and 37 and grooves 36 and 51 have surfaces 54 that extend longitudinally in their respective direction of insertion 30 or 31.

During operation of the assembly 22, the container 10 is closed so that the lid 14 abuts the body 11. Accordingly, the bases 23 and 24 are located adjacent each other. Thereafter the insert 26 is inserted in the slot 28 in the direction 30 until it abuts an end wall 43 of the base 23. In an alternative embodiment there is no end wall 43 so that the insert 26 can pass all the way through the base 23. The insert 27 is then inserted in the slot 29 and moved in the direction 31 until the projection 42 is located in the recess 41. Any seal (such as a pressure sensitive seal) or tag, such as the abovementioned RFID tag 53 is secured to the inserts 26 and 27 so as to extend therebetween. The container 10 can only be opened when the tag 53 is disturbed. This will then provide evidence of opening and/or tamper.

To provide for application and removal of the abovementioned tag 53, the bases 23 and 24 cooperate to provide a window 44 that exposes major surfaces 45 and 46 of the inserts 26 and 27. More particularly the base 23 has window side portions 47 that cooperate with window side portions 48 of the base 24 to surround the window 44 and expose the major surfaces 45 and 46.

Figure 3:
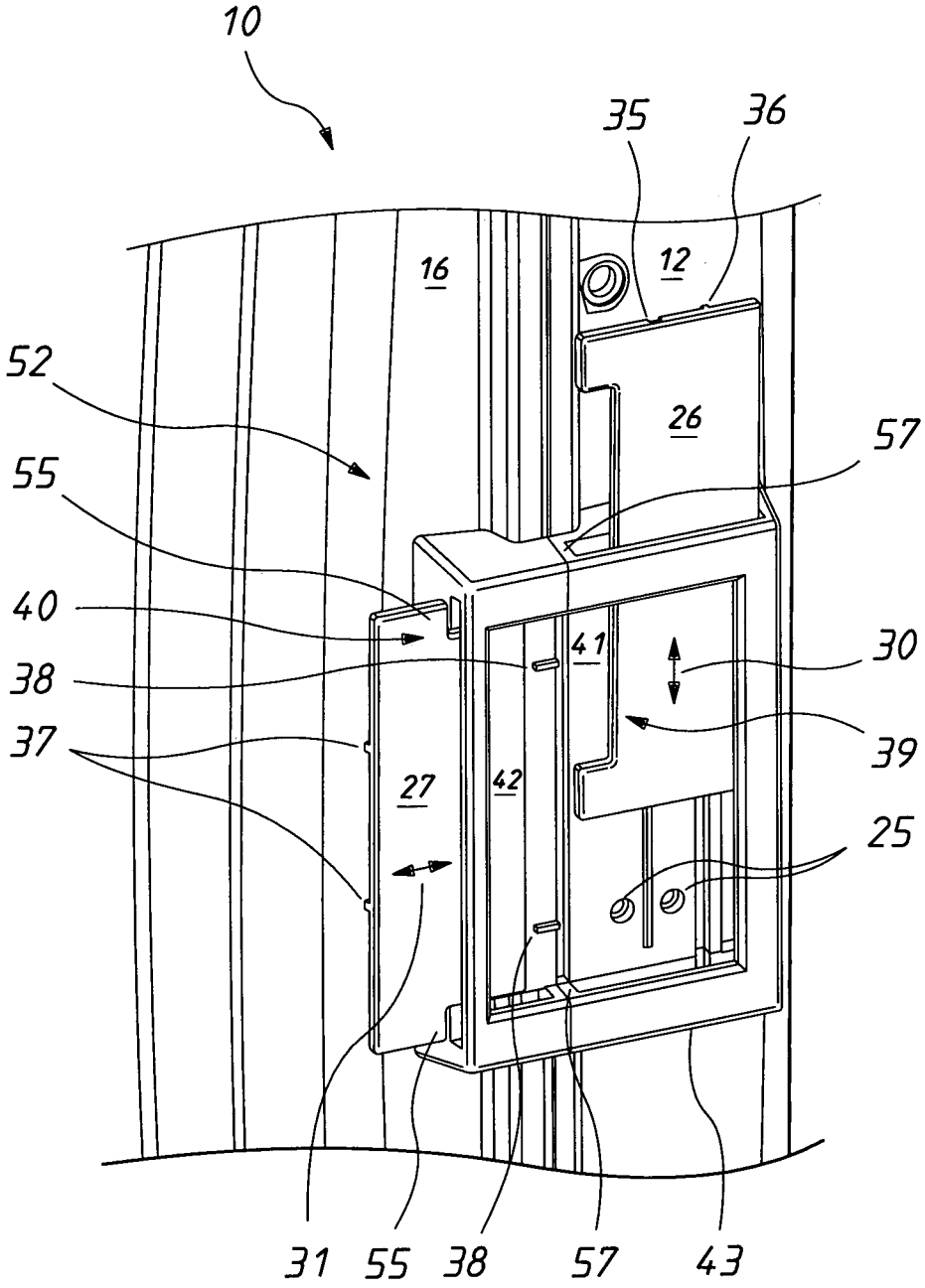
FIG. 3 is a schematic isometric view of the security assembly of FIG. 1 in a partly assembled configuration.
Figure 4:
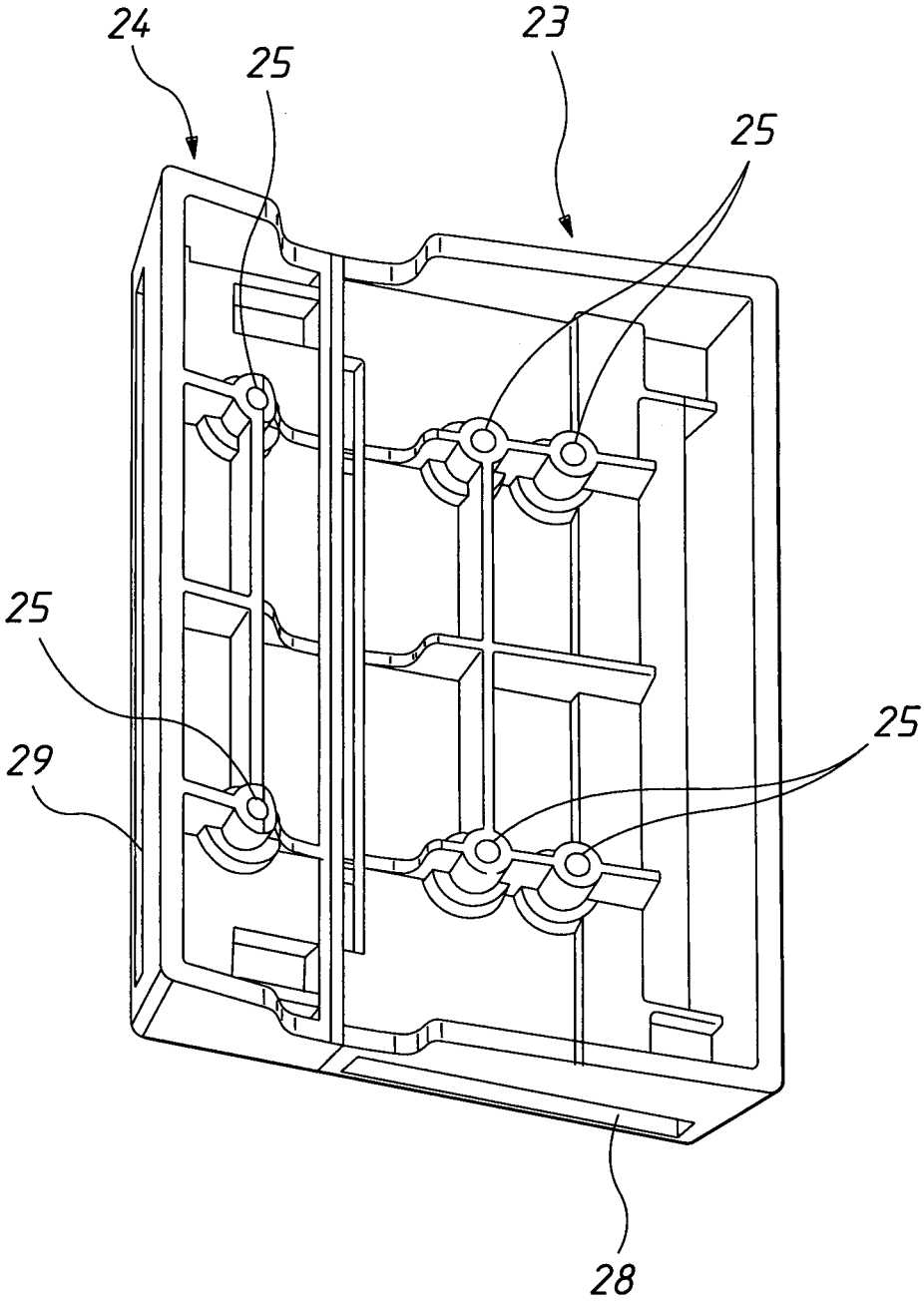
FIG. 4 is a schematic rear isometric view of the security assembly of FIG. 1.

As is best seen in FIG. 3, when the inserts 26 and 27 are secured in position within the bases 23 and 24, the fasteners passing through the collars 25 are not exposed.

Figure 5:
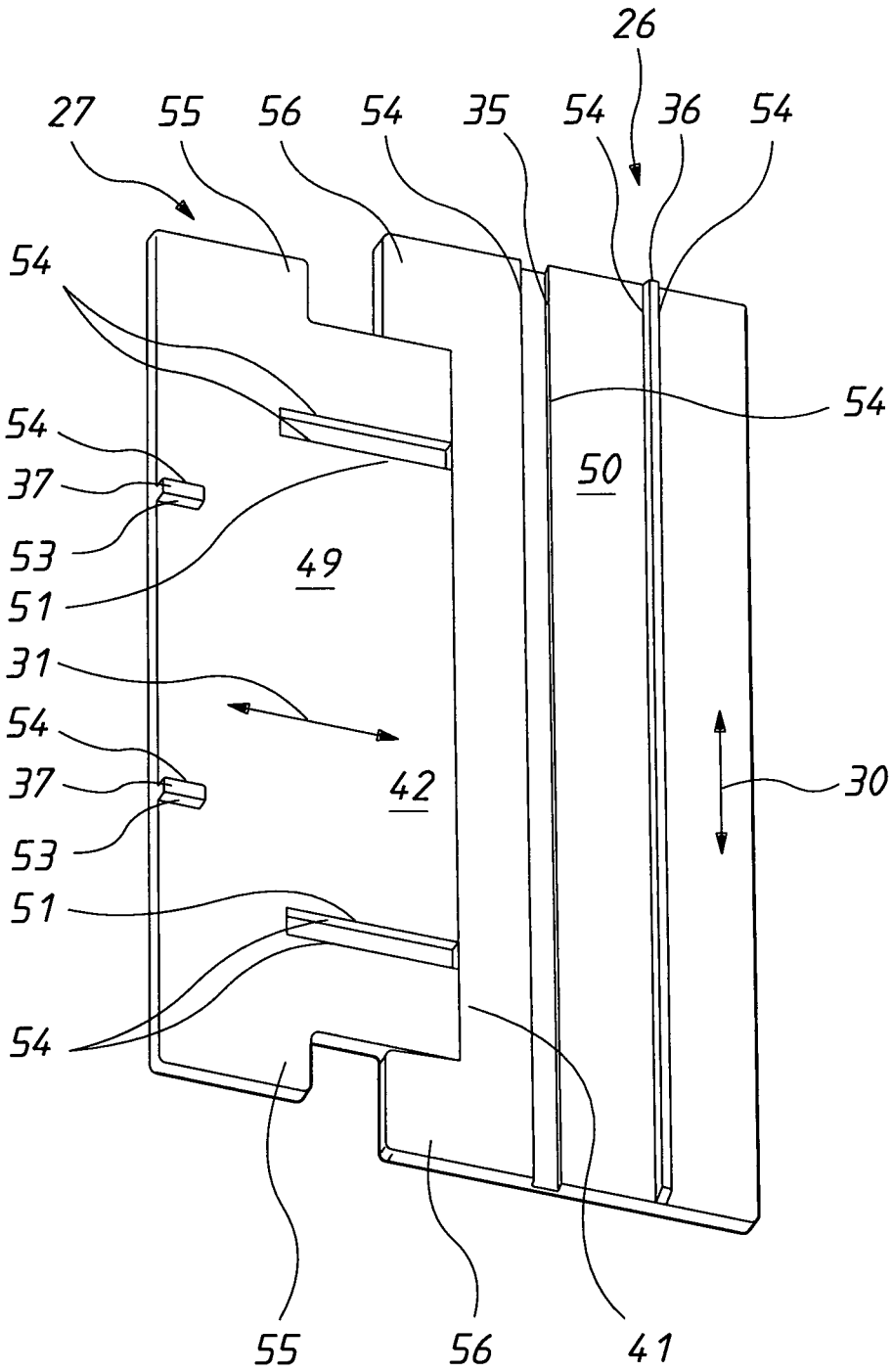
FIG. 5 is a schematic rear isometric view of a pair of inserts employable in a security assembly of FIG. 1.
Figure 6:
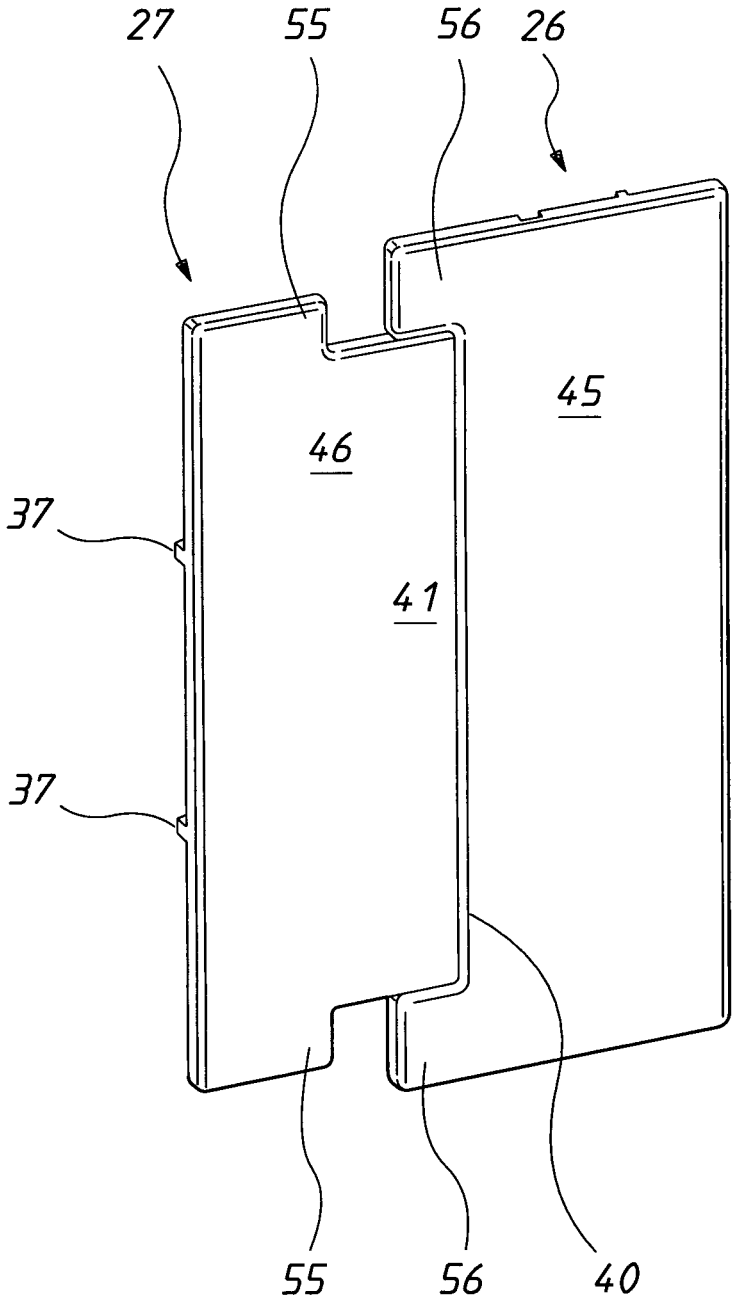
FIG. 6 is a schematic front isometric view of the inserts of FIG. 5.

In FIG. 5 the rear major surfaces 49 and 50 can be seen. In the case of the insert 27, the surface 49 is interrupted by the security features 37 and 51, while the surface 50 is interrupted by the features 35 and 36. Each of the features 35, 36, 37 and 51 extend from their respective surface 49 or 50.

Figure 7:
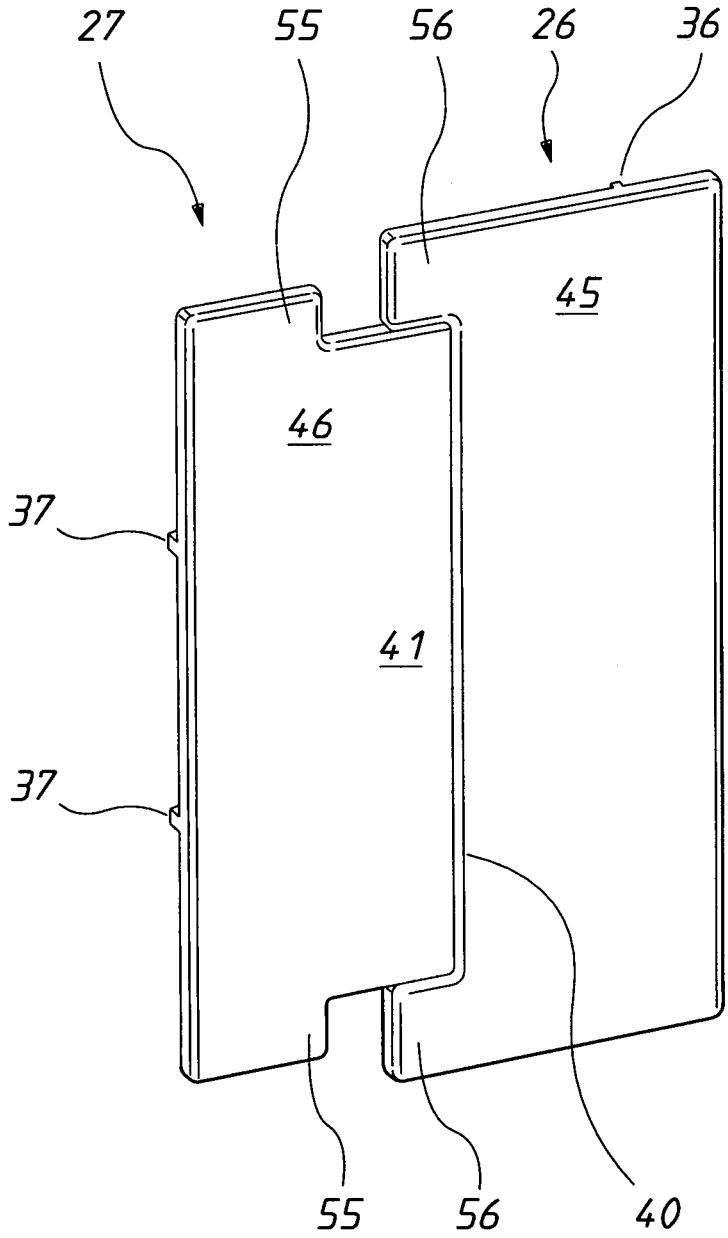
FIG. 7 is a schematic front isometric view of a pair of alternative inserts.
Figure 8:
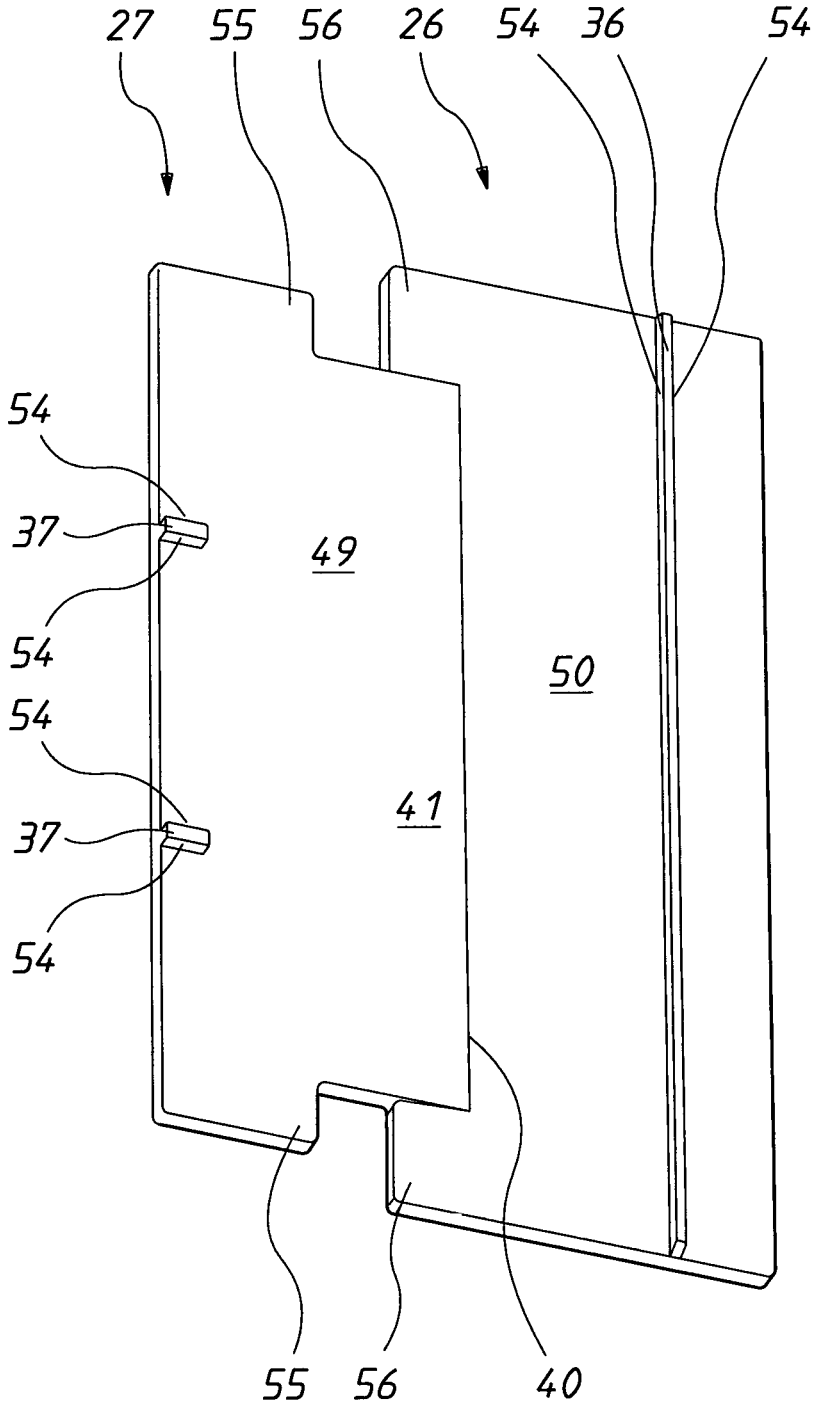
FIG. 8 is a schematic rear isometric view of the inserts of FIG. 7.
Figure 9:
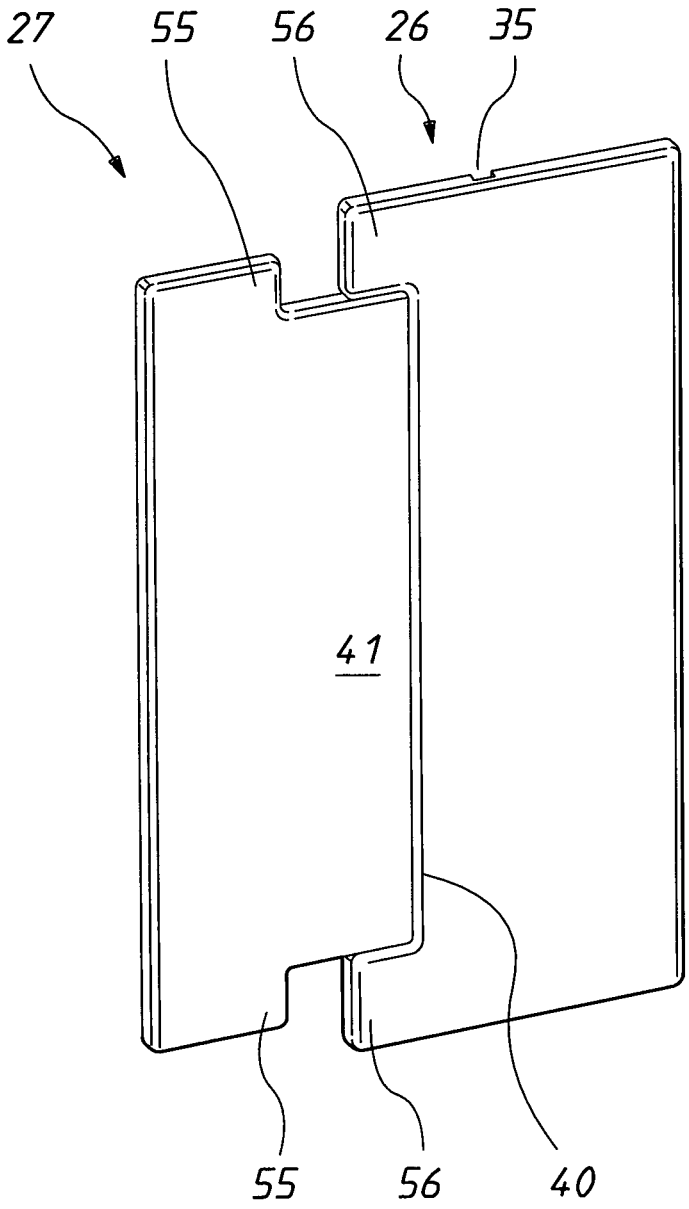
FIG. 9 is a schematic front isometric view of a still further pair of alternative inserts.
Figure 10:
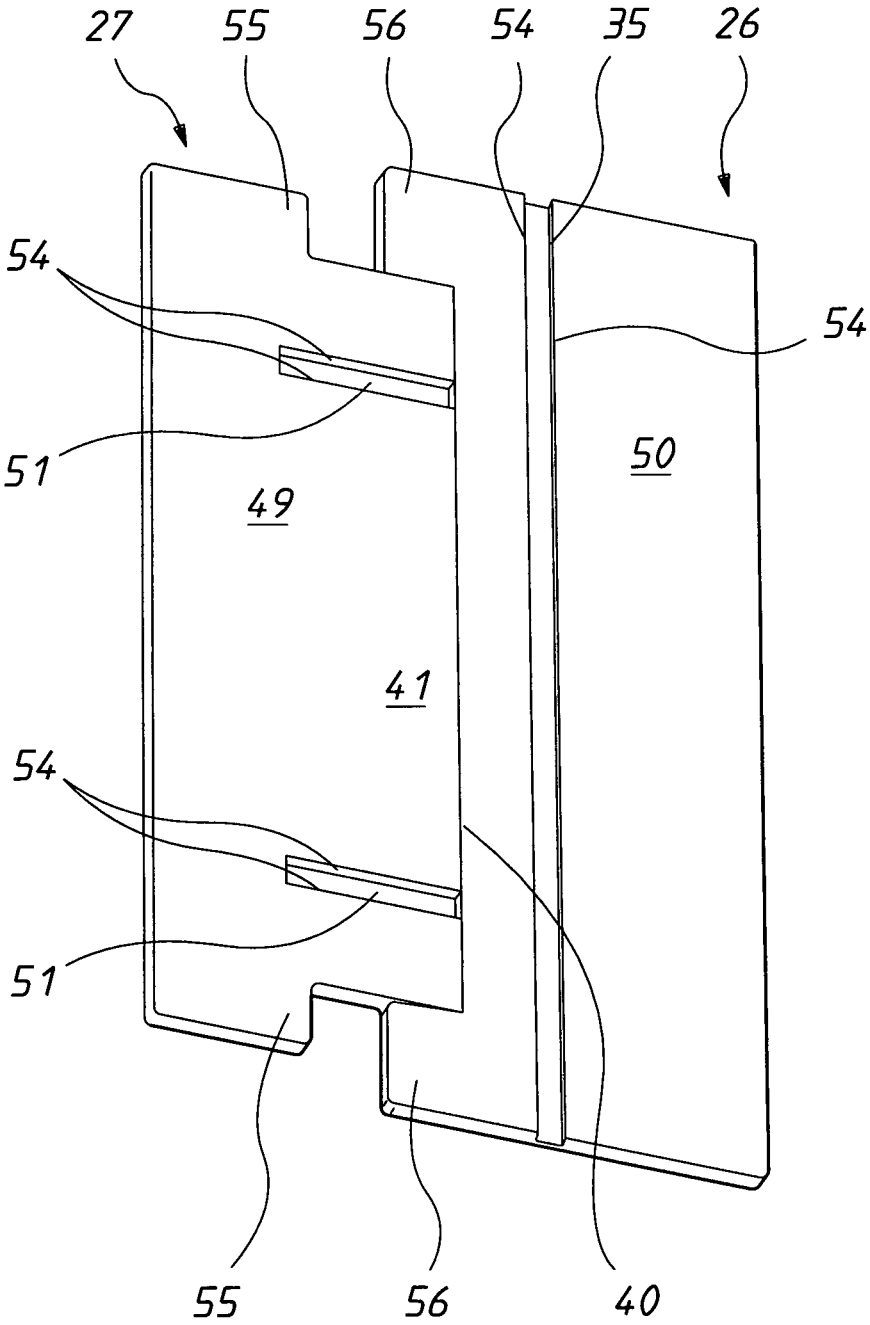
FIG. 10 is a schematic rear isometric view of the inserts of FIG. 9.

In the embodiment of FIGS. 7 and 8, the inserts are only provided with the features 37 and 36 while in the embodiment of FIGS. 9 and 10, the inserts 26 and 27 are only provided with features 35 and 51.

It should further be appreciated that each of the inserts 26 and 27 can only be removed from their respective base 23 or 24 via their respective slot 28 or 29 irrespective of whether the container 10 is opened or closed. Accordingly, if an attempt is made to open the container 10, the inserts 26 and 27 are caused to move away from each other thereby deforming the tag 53. It should be appreciated the tag 53 is secured by an adhesive to the surfaces 45 and 46 so as to extend therebetween. In use, upon correct location of the inserts 26 and 27 in the bases 23 and 24 the tag 53 is applied to the surfaces 45 and 46.

The insert 27 has shoulders 55 that engage the base 24 so that it cannot pass through the base 24, while the insert 26 has a length in the direction 30 that prevents it passing through the slot 29. That is when the inserts 26 and 27 are engaged, the projections 56 would abut the portions 57 of the base 23. When the inserts 26 and 27 are joined by the tag 53, the inserts 26 and 27 cannot be withdrawn from the bases 23 and 24 without deforming the tag 53.

In FIGS. 11 to 20 of the accompany drawings, there is schematically depicted a modification of the container 10. In this embodiment, the security device 52 has modified bases 23 and 24 and modified inserts 26 and 27.

In this embodiment, each of the bases 23 and 24 has a shaped recess 60 that includes a first recess part 61, extending from an end face 62 of the base 24, and from which there extends a second recess part 63 extending to a face 64. The face 64 is generally perpendicular to the face 62 with the face 64 being positioned to abut the insert 27. Each of the recesses 60 by having the part 63 narrower than the part 61 is of a "T" configuration.

To engage within each shaped recess 60, the inserts have an engagement portion 65. In particular each insert 26 and 27 has an insert base 66 from which there projects the portions 65. Each portion 65 includes a stem 67 from which there projects a transverse bar 68. The stem 67 also projects from the bar 68 to reinforce the bar 68. The bar 68 has a width greater than the stem 67 so that the bar 68 is located in part 61 with the stem 67 projection through the part 63. The bar 68 is located below the surface 62.

By engagement of the bar 68 in the part 61, movement of the base 66 away from the surface 64 is prevented or at least inhibited. This prevents or at least inhibits deformation particularly resilient deformation of the inserts 26 and 27 so that they can be removed from the slots 70. The slots 70 are all parallel and are arranged so that each base 23 and 24 has a pair of slots 70 that are spaced to provide for the location of the respective insert 26 or 27 therein.

Figure 19:
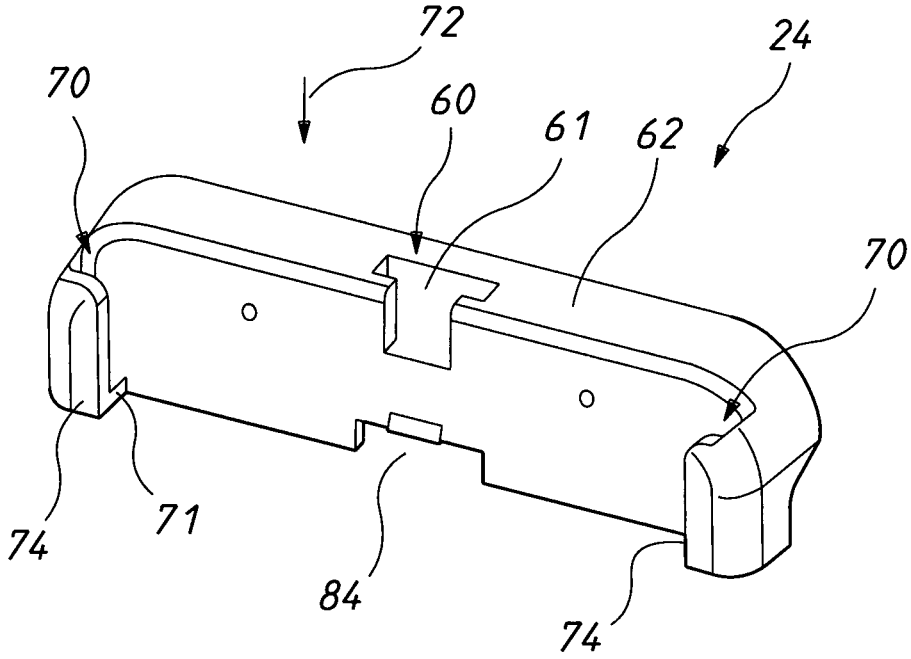
FIG. 19 is a schematic front isometric view of a further base of the briefcase of FIG. 12.
Figure 20:
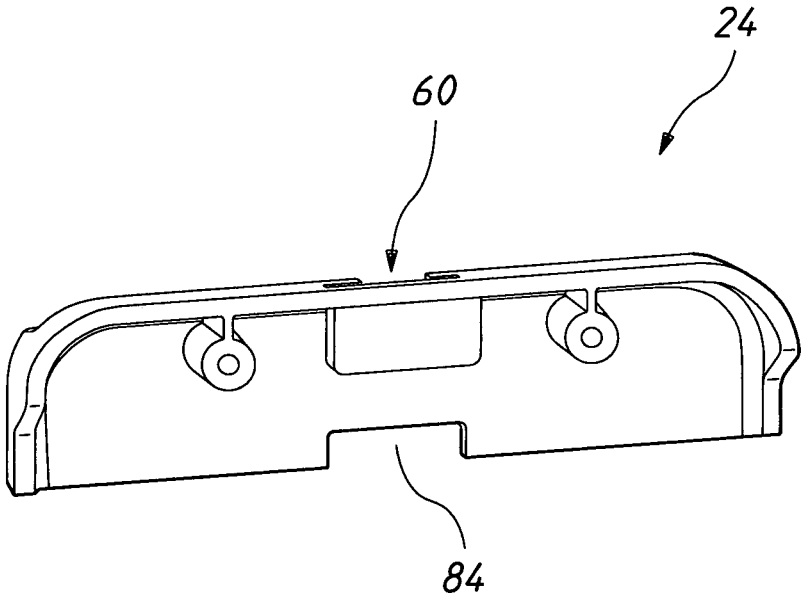
FIG. 20 is a schematic rear isometric view of the base of FIG. 19.

With reference to FIGS. 19 and 20, the base 24 is fully depicted. The base 23 is essentially a mirror image of the base 24 so as to also have the slots 70 and recess 60.

Each slot 70 terminates with the flange 71 against which the associated insert 26 or 27 abuts. The flanges 71 of the base 24 are located adjacent the flanges 71 of the base 23 with the slots 70 of the base 24 projecting away from their associated flanges 71 in the opposite direction to the slots 70 of the base 23. The slots 70 are generally parallel to the face 64 with the inserts 26 and 27 being inserted in their respective base in the direction of the arrow 72. The slots 70 of each associated pair of slots 70 are generally co-extensive. The arrow 72 is generally parallel to the face 64 but perpendicular to the face 62.

The slots 70 are located generally in the same plane so that the inserts 26 and 27 are aligned also in a common plane to provide for the location of a security seal to be secured to the inserts 26 and 27 as discussed previously.

Each slot 70 is located between its associated face 64 and an elongated flange 74 extending in the direction 72. Each flange 74 terminates adjacent or at the flange 71. Each flange 71 is generally normal to its associated flange 74.

Figure 13:
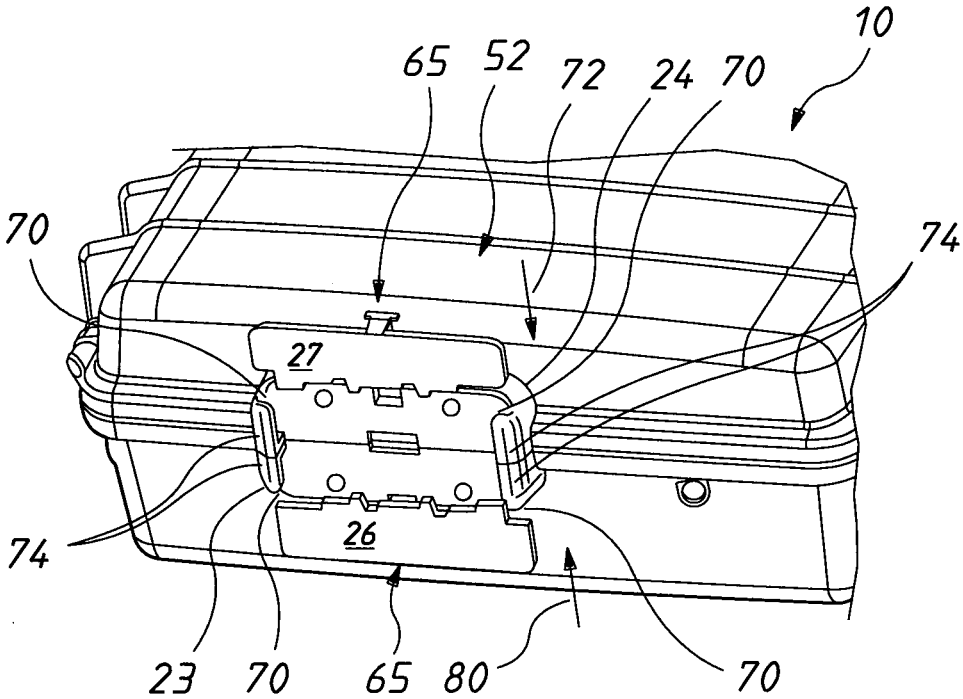
FIG. 13 is a schematic isometric view of the briefcase of FIG. 12 with the security device partly disassembled.
Figure 14:
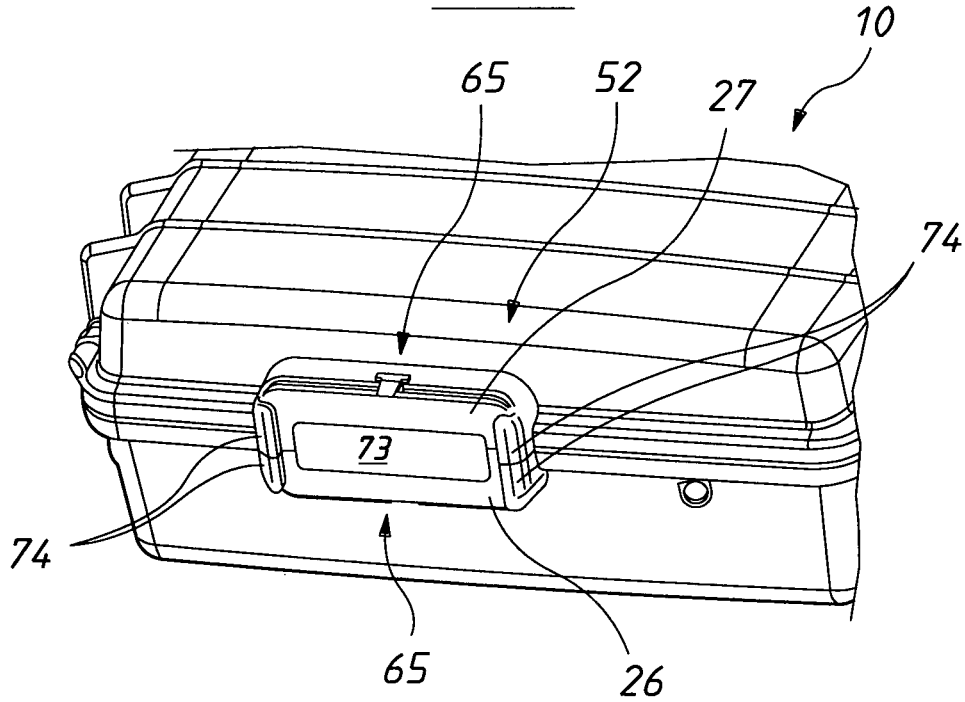
FIG. 14 is a schematic isometric view of the briefcase of FIG. 12 with the security device in position with a security seal.
Figure 15:
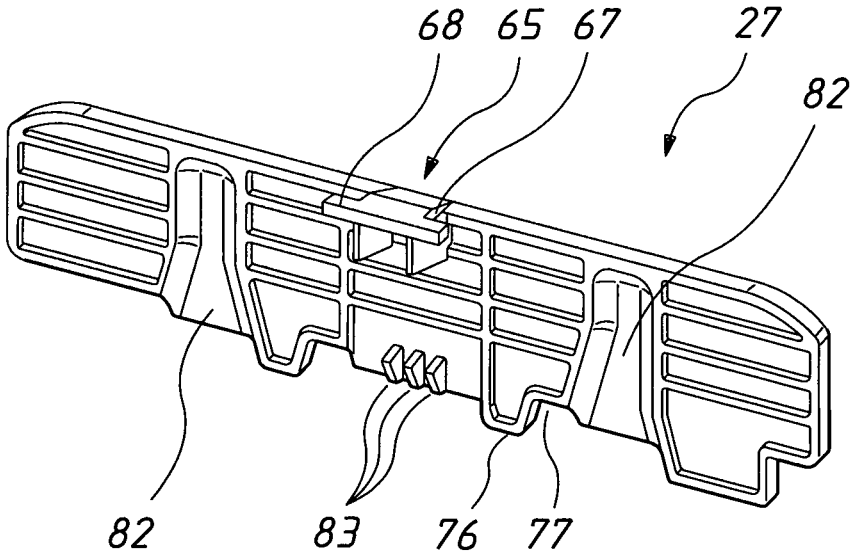
FIG. 15 is a schematic rear isometric view of an insert employed with the security device of the briefcase as shown in FIGS. 12, 13 and 14.
Figure 16:
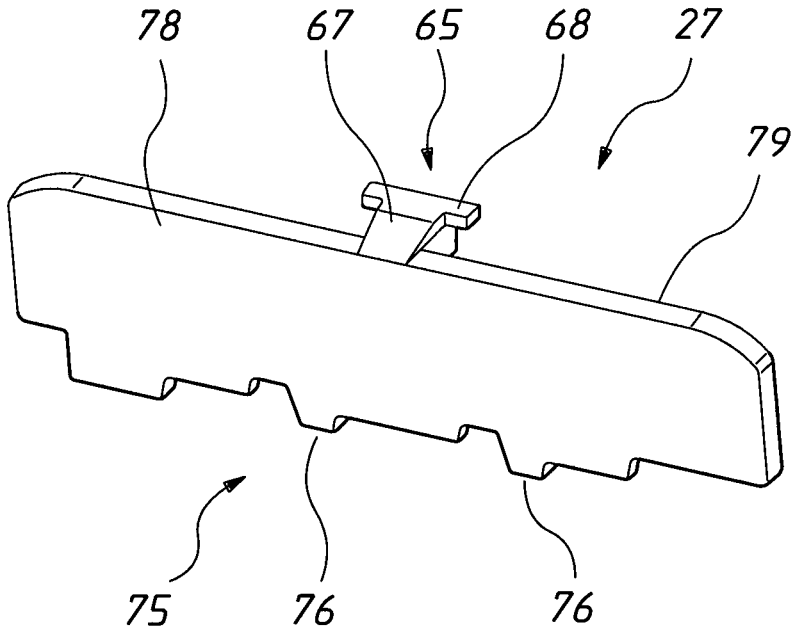
FIG. 16 is a schematic front isometric view of the insert of FIG. 15.
Figure 17:
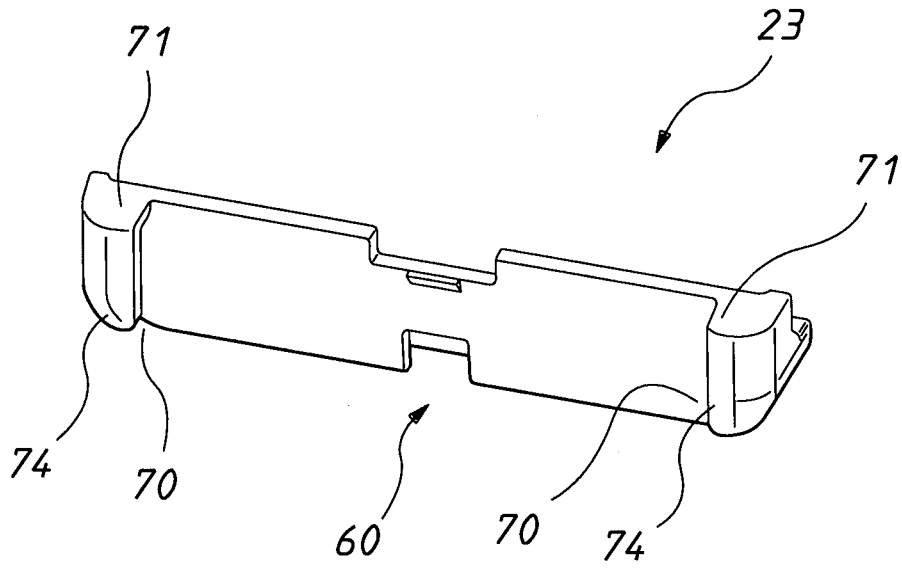
FIG. 17 is a schematic front isometric view of a base of the security device of the briefcase of FIG. 12.
Figure 18:
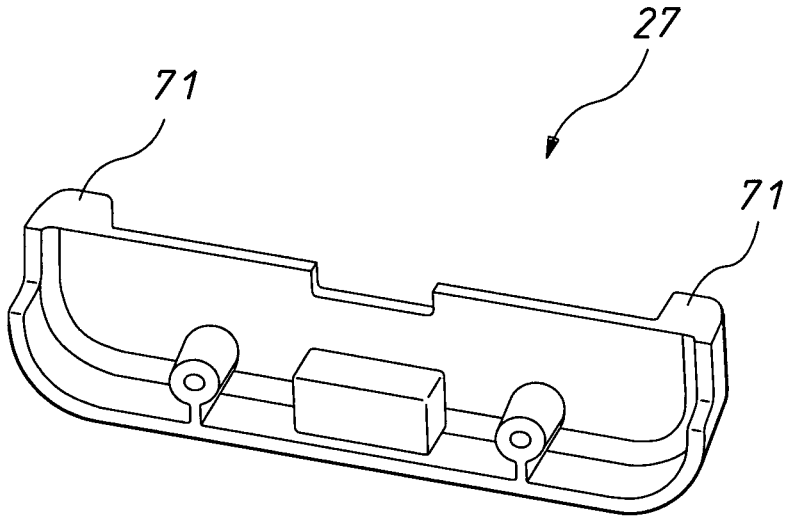
FIG. 18 is a schematic rear isometric view of the base of FIG. 17.

As is easily seen in FIGS. 13 and 16, each of the inserts 26 and 27 has an insert engagement edge 75 that has its major direction of extension generally normal to the direction 72. The edges have projections 76 and recesses 77 that matingly engage when the edges 75 are abutting. The seal 73 extends across the abutting edges 75.

Each base 66 has a first face 78 and a second face 79 separated by the thickness of the base 66. The faces 78 and 79 are generally planar and substantially parallel and substantially co-extensive. The stem 67 has a major direction of extension that is generally normal to both faces 78 and 79 so that the bar 68 is displaced from the face 79 so as to be further displaced from the face 78.

In the embodiment of FIGS. 11 to 18, it should be appreciated the inserts 26 and 27 are inserted in their respective slot 70 in opposite directions. The insert 27 is inserted in the direction 72 while the insert 26 is inserted in the direction 80, the direction 80 being opposite to the direction 72. When each insert 26 or 27 is inserted in its respective direction, the bar 68 of the respective insert 26 or 27 is moved into its associated shaped slot 60. Simultaneously, the projections 76 and recesses 77 engage.

Figure 11:
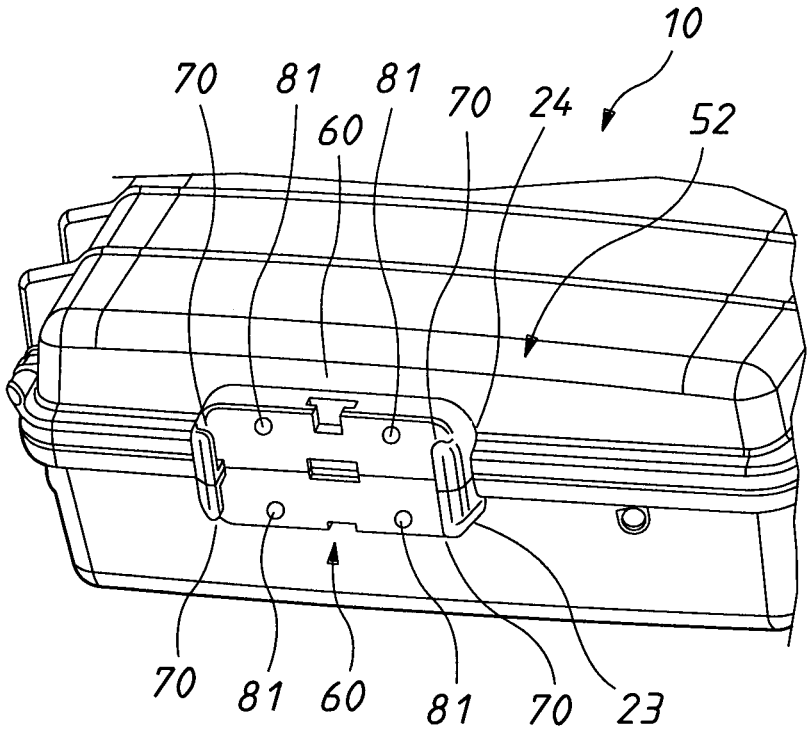
FIG. 11 is a schematic isometric view of a further briefcase including a further security device.
Figure 12:
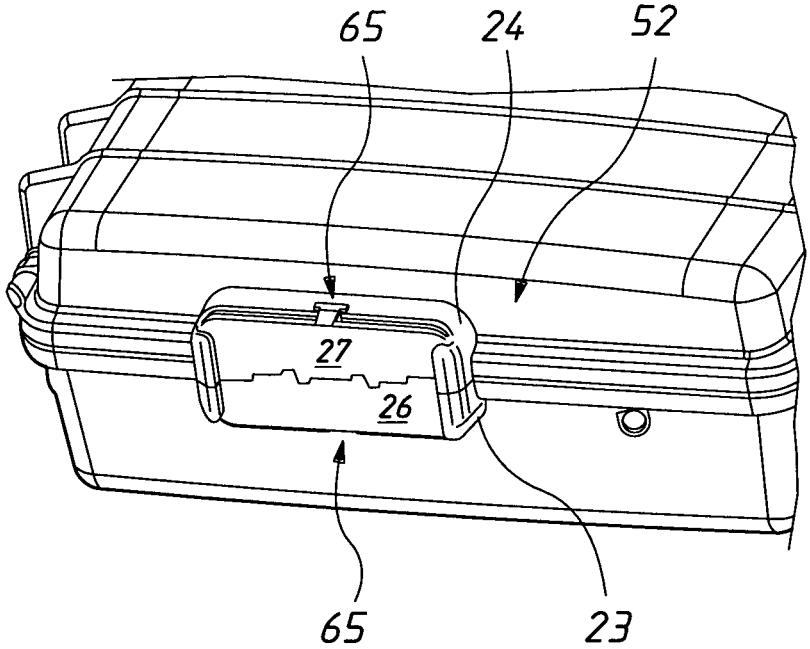
FIG. 12 is a schematic isometric view of the briefcase of FIG. 11 with inserts employed in the security device.

As best seen in FIG. 11, the bases 23 and 24 are secured to the walls 12 and 16 by fasteners 81. The inserts 26 and 27 have slots 82 that provide for movement of the inserts 26 and 27 in their respective direction 72 or 80 by having the fasteners 81 move along the slots 82. Still further, each of the inserts 26 and 27 has at least one projection 83 that slide along the respective surface 64 to engage within the recess 84. During movement along the surface 64, the projections 83 by engagement with the surface 64 resiliently deform the inserts 26 and 27 until the projections 83 are engaged within the associated recesses 84. Accordingly when removing the inserts 26 and 27 after rupturing the seal 73, a positive force must be applied to the inserts 26 and 27 to remove them from their respective base 23 or 24.

In respect of the embodiments of FIGS. 1 to 10, the inserts 26 and 27 are inserted in their respective slots 70 in directions which are generally normal. However other directions are contemplated, that is the inserts 26 and 27 may be inserted in directions that are inclined by an angle greater than 0° but equal to or less than 180°. In the embodiment of FIGS. 11 to 20, the inserts 26 and 27 are inserted in opposite directions 72 and 80.

The invention claimed is:

1. A plurality of inserts to be located each in a respective slot so that the inserts have adjacent major surfaces between which a label, seal or tag is to extend and to be fixed thereto, said inserts including:

a first insert to be inserted in one of the slots in a first insert direction, the first insert having a first one of the major surfaces and at least one first security surface interrupting said first major surface so as to extend therefrom, said first security surface extending in said first insert direction;

a second insert to be inserted in another of said slots in a second insert direction, the second insert having a second one of the major surfaces and at least one second security surface interrupting the second major surface so as to extend therefrom, said second security surface extending in said second insert direction; and wherein each security surface is provided by a groove in said major surface or a ridge on said major surface, said groove or ridge extending longitudinally in the direction of the respective insert and said first insert direction is generally normal to said second insert direction.

2. The inserts of claim 1, wherein each insert has at least two of said security surfaces.

3. The inserts of claim 1, wherein each insert has at least one groove and at least one ridge.

4. The inserts of claim 1, wherein said first insert has a leading edge, and said second insert includes a lateral edge, and wherein said edges are configured to engage to prevent separation of the inserts by movement in said first insert direction and/or said second insert direction.

5. The inserts of claim 4, wherein said leading edge includes a projection, and said lateral edge includes a recess to matingly engage said projection.

6. The inserts of claim 1, wherein said first insert direction is inclined to said second insert direction by an angle greater than 0° but equal to or less than 180°.

7. The inserts of claim 1, wherein said first insert direction is opposite said second insert direction.

8. In combination the inserts of claim 1 with said label, seal or tag secured to said adjacent surfaces.

9. A security assembly to be fixed to a container having a body and lid, said assembly including:

the plurality of inserts as recited in claim 1;

a first base, said first base being fixed to said body, and a second base to be fixed to said lid, and wherein said first base provides a slot to receive the first insert, and said second base provides a second slot to receive the second insert, with each base having a ridge or groove to matingly engage the ridge or groove of the associated insert.

10. A container having a body and lid, and the security assembly of claim 9.

11. A plurality of inserts to be located each in a respective slot so that the inserts have adjacent major surfaces between which a label, seal or tag is to extend and to be fixed thereto, said inserts including:

a first insert to be inserted in one of the slots in a first insert direction, the first insert having a first one of the major surfaces and at least one first security surface interrupting said first major surface so as to extend therefrom, said first security surface extending in said first insert direction;

a second insert to be inserted in another of said slots in a second insert direction, the second insert having a second one of the major surfaces and at least one second security surface interrupting the second major surface so as to extend therefrom, said second security surface extending in said second insert direction; wherein each security surface is provided by a groove or ridge extending longitudinally in the direction of the respective insert; and said first insert direction is generally normal to said second insert direction.

12. The inserts of claim 11, wherein said first insert has a leading edge, and said second insert includes a lateral edge, and wherein said edges are configured to engage to prevent separation of the inserts by movement in said first insert direction and/or said second insert direction.

13. The inserts of claim 12, wherein said leading edge includes a projection, and said lateral edge includes a recess to matingly engage said projection.

14. The inserts of claim 11, wherein each insert has at least two of said security surfaces.

15. A plurality of inserts to be located each in a respective slot so that the inserts have adjacent major surfaces between which a label, seal or tag is to extend and to be fixed thereto, said inserts including:

a first insert to be inserted in one of the slots in a first insert direction, the first insert having a first one of the major surfaces and at least one first security surface interrupting said first major surface so as to extend therefrom, said first security surface extending in said first insert direction;

a second insert to be inserted in another of said slots in a second insert direction, the second insert having a second one of the major surfaces and at least one second security surface interrupting the second major surface so as to extend therefrom, said second security surface extending in said second insert direction; wherein each security surface is provided by a groove or ridge extending longitudinally in the direction of the respective insert; and at least one of said inserts has a securing portion spaced from the major surface thereof to inhibit deformation of the one insert thereby inhibiting removal of the one insert from its associated slots.

16. In combination with the inserts of claim 15, wherein the combination further includes a first base to receive said first insert and providing the slot within which the first insert is located, and a second base, the second base providing the slot within which said second insert is to be located, and wherein at least one of said bases has a recess to engage the securing portion to prevent deformation of the one insert to thereby inhibit removal of the one insert from within the associated slots.

17. A plurality of inserts to be located each in a respective slot so that the inserts have adjacent major surfaces between which a label, seal or tag is to be fixed thereto, said inserts including:

a first insert to be inserted in one of the slots in a first insert direction, the first insert having a first one of the major surfaces and at least one first security surface interrupting said first major surface so as to extend therefrom, said second security surface extending in said second insert direction;

a second insert to be inserted in another of said slots in a second insert direction, the second insert having a second one of the major surfaces and at least one second security surface interrupting the second major surface so as to extend therefrom, said second security surface extending in said second insert direction; and wherein each security surface is provided by a groove in said major surface or a ridge on said major surface, said groove or ridge extending longitudinally in the direction of the respective insert;

the first insert has a leading edge having projections and recesses;

the second inset has a leading edge with a plurality of projections and recesses, with the projections and recesses of the inserts being engaged to provide for location of said adjacent surfaces so that the label, seal or tag can be applied thereto; and at least one of said inserts has a securing portion spaced from the major surface thereof to inhibit deformation of the one insert thereby inhibiting removal of one insert from its associated slots.

18. In combination with the inserts of claim 17, wherein the combination further includes a first base to receive said first insert and providing the slot within which the first insert is located, and a second base, the second base providing the slot within which said second insert is to be located, and wherein at least one of said bases has a recess to engage the securing portion to prevent deformation of the one insert to thereby inhibit removal of the one insert from within the associated slots.

* * * * *